US007128314B2

(12) United States Patent
Iida

(10) Patent No.: US 7,128,314 B2
(45) Date of Patent: Oct. 31, 2006

(54) BANKNOTE DISPENSING DEVICE

(75) Inventor: Joji Iida, Hachiouji (JP)

(73) Assignee: Asahi Seiko Co., Ltd., Tokyo (JP)

( * ) Notice: Subject to any disclaimer, the term of this patent is extended or adjusted under 35 U.S.C. 154(b) by 76 days.

(21) Appl. No.: 10/647,730

(22) Filed: Aug. 25, 2003

(65) Prior Publication Data

US 2004/0108647 A1 Jun. 10, 2004

(30) Foreign Application Priority Data

Aug. 27, 2002 (JP) ..... 2002-247804

(51) Int. Cl.
*B65H 5/00* (2006.01)

(52) U.S. Cl. ..... 271/4.02; 271/10.02; 271/259; 271/265.03; 209/534; 902/8

(58) Field of Classification Search ..... 271/3.15, 271/3.17, 4.01, 4.02, 4.03, 4.07, 4.1, 10.02, 271/10.03, 10.09, 10.11, 116, 258.01, 259, 271/265.02, 265.03, 314; 209/534, 586; 902/8

See application file for complete search history.

(56) References Cited

U.S. PATENT DOCUMENTS

| | | | | |
|---|---|---|---|---|
| 3,907,278 | A | 9/1975 | Jaton | |
| 4,030,722 | A * | 6/1977 | Irvine et al. | 271/10.13 |
| 4,154,437 | A | 5/1979 | Butcheck et al. | |
| 4,179,031 | A * | 12/1979 | Ward | 209/534 |
| 4,355,797 | A | 10/1982 | Graef et al. | |
| 4,552,350 | A * | 11/1985 | Nagy et al. | 271/3.19 |
| 4,564,122 | A * | 1/1986 | Granzow et al. | 221/12 |
| 4,570,801 | A * | 2/1986 | Brannen | 209/534 |
| 4,577,763 | A * | 3/1986 | Placke et al. | 209/534 |
| 4,615,350 | A | 10/1986 | Boudville | |
| 4,895,358 | A | 1/1990 | Kawasaki | |
| 5,310,173 | A | 5/1994 | Martinez | |
| 5,462,267 | A * | 10/1995 | Hori | 271/10.04 |
| 5,535,894 | A | 7/1996 | Ishiwata | |
| 5,607,352 | A | 3/1997 | Tani | |
| 5,711,704 | A | 1/1998 | Hughes et al. | |
| 6,206,284 | B1 * | 3/2001 | Do et al. | 235/379 |
| 6,705,470 | B1 * | 3/2004 | Klein et al. | 209/534 |

FOREIGN PATENT DOCUMENTS

| | | |
|---|---|---|
| JP | 62-275948 | * 11/1987 |
| JP | 06-092491 | 5/1994 |
| JP | 6-43767 | 6/1994 |
| JP | 6-190138 | 7/1994 |
| JP | 11-25309 | 1/1999 |
| JP | 11-353532 | 12/1999 |
| JP | 2002-92700 | 3/2002 |

* cited by examiner

*Primary Examiner*—Donald P. Walsh
*Assistant Examiner*—Thomas Morrison

(57) ABSTRACT

A banknote dispensing device including a storage section for storing one or more banknotes, a discharging unit driven by a first motor for discharging banknotes one-by-one at a first speed, and a transporting unit driven by a second motor for receiving the discharged banknotes from the discharging unit and transporting the discharged banknotes at a second speed where the second speed is faster than the first speed, the one-way clutch permitting the discharged banknote to be continuously drawn at the second speed without damaging the discharged banknote. The banknote dispensing device includes one or more sensors connected to a control unit, the control unit determining whether the transported banknote is transported properly and turning off the motors in an error condition.

3 Claims, 6 Drawing Sheets

BANKNOTE DISPENSING DEVICE

CROSS-REFERENCE TO RELATED APPLICATION

This application is based on an application number 2002-247804 filed in Japan, dated Aug. 27, 2002.

1. Field of the Invention

The present invention is related to a banknote dispensing device. More particularly, the present invention is related to a banknote dispensing device which transports a banknote faster than the discharge speed from an internal banknote supply storing section without damaging the banknote.

2. Description of Related Art

Previously, when a banknote was discharged or let off from a banknote supply storing section at one speed and then taken up by a transporting unit at a higher speed, the banknote would be damaged due to the difference in speeds. Usually, the damage to the banknote occurs because the drive mechanisms, such as feed rollers, that contact the banknote in both the banknote supply storing section and the banknote transporting unit are simultaneously engaged with the banknote while driving the banknote at different speeds. This difference in speeds may apply a shearing force to the banknote thereby damaging the banknote.

One attempt to address this problem has been to provide a drive mechanism with a projection on the periphery of the drive mechanism. This projection is used to positively engage a banknote and move it in the direction of the transport unit feed rollers. However, the drive mechanism with the projection must not have contact with the banknote at the point the banknote engages with the transport unit feed rollers since the projection would cause significant damage to the banknote.

Instead, the drive mechanism with the projection only engages the banknote for a portion of the travel, and allows the banknote to continue for a period of time before engaging with the transport unit feed roller. This period of time where the banknote is not positively engaged, with either the drive mechanism with a projection or the feed rollers of the transport unit, allows the banknote to travel freely and may allow the banknote to stall or become misaligned.

In an attempt to reduce the time the banknote is not positively driven, another device including a drive mechanism with a clutch was used. The clutch mechanism determines when the drive mechanism is driving the banknote and can be declutched, or disengaged, from driving prior to the moment the banknote arrives at the transporting feed rollers.

This method requires a very precise control of the declutching so as to avoid any time when the banknote is both driven simultaneously by the drive mechanism of the banknote supply storing section and being pulled by the feed rollers of the banknote transport unit. If the declutching occurs too late, the banknote may be damaged as discussed above. If the declutching occurs too early, the banknote may stall or become misaligned causing jamming or other malfunction.

Finally, a compromise method was used that allows a limited freedom to advance the banknote as it is discharged by a banknote supply storing section and then pulled at a higher speed by a transport unit such as that described in the Japanese laid open patent 6-92491. In this case, a drive shaft with a radial projection drives a feed roller in one direction of rotation. The projection is within a cavity region within the feed roller so that the feed roller may be advanced in the direction of rotation a limited amount, causing the projection to loose contact with the driven edge. This allows a limited amount of rotational freedom where the disengagement of the projection with the feed roller allows the banknote to be advanced. This method suffers from the obvious limitation that the feed roller only allows a limited amount of advancement of only ¼ turn in the cited reference.

SUMMARY OF THE INVENTION

The present invention provides a novel banknote dispensing device utilizing a one-way clutch for transferring a banknote from a banknote supply storage section at one speed to a banknote transporting unit at a second, higher speed while avoiding damage to the banknote due to this difference in speed in the transfer.

The banknote dispensing device includes a banknote supply storing section for storing banknotes, a banknote discharging unit for discharging the banknotes at a first speed, a banknote transporting unit for transporting the discharged banknote at a second, higher speed, a package dispensing member to output the discharged banknotes, and a control unit for receiving signals from and controlling the actions of the dispensing device.

The banknotes are discharged from the banknote supply storing section by the banknote discharge unit using a feed roller driven by a one-way clutch at a first predetermined speed. The discharged banknote is received by the banknote transporting device that pulls the discharged banknote at a second predetermined speed which is faster than the first speed. When the banknote is pulled at the second, faster speed, the one-way clutch driving the feed roller in the discharge unit automatically allows the banknote to be continuously pulled at the faster speed without damaging the banknote.

The dispensing device includes four sensors and two motors. The first sensor detects the banknote as it is received by the transporting device. The second sensor detects the presence of the banknote at the rejected banknote discharge point from the dispensing device. The third sensor detects the presence of the banknote at the normal banknote discharge point. The fourth sensor detects accumulated banknotes protruding from the dispensing slot. The first motor drives the discharging unit while the second motor drives the transporting unit.

The dispensing device includes a control unit that interprets the signals from the sensors to determine whether the banknote has been discharged and transported properly. The control unit outputs signals to activate the motors and the package dispensing member. When an error condition is detected, the motors are stopped.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENTS

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the intention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

Figure 1:
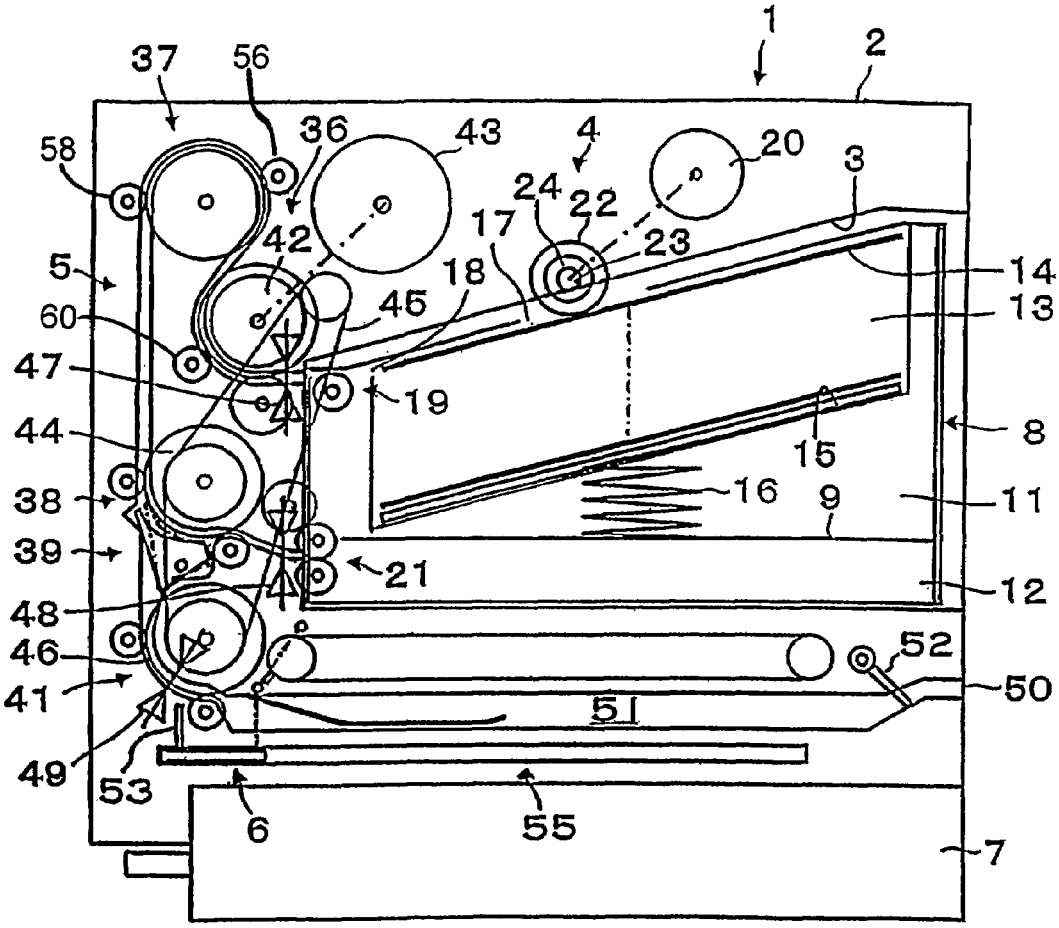
FIG. 1 shows an embodiment of the present invention.

In reference to FIG. 1, the present invention provides a novel banknote dispensing device 1 utilizing a one-way clutch 24 for transferring a banknote from a banknote supply storing section 13 at one speed to a banknote transporting unit 5 at a second, higher speed while avoiding damage to the banknote due to the difference in speed in the transfer.

In this specification, a banknote may be paper currency, a certificate, a bill, a note, or any similar thin, flexible article of a substantially rectangular shape that may be stored, manipulated, and dispensed as herein described.

The banknote dispensing device includes a banknote supply storing section 13 for storing banknotes, a banknote discharging unit 4 for discharging the banknotes at a first speed, a banknote transporting unit 5 for transporting the discharged banknote at a second, higher speed, a package dispensing member 6 to outputting the discharged banknotes, and a control unit 7 for receiving signals from and controlling the actions of the dispensing device.

The banknote discharge unit 4 includes a first motor 20 driving a driving shaft 23. The driving shaft in turn drives a one-way clutch 24 that drives a feed roller 22. The control unit 7 enables the first motor 20 to drive the feed roller 22 in order to discharge banknotes from the banknote supply storing section 13.

The feed roller 22 has a peripheral edge adjacent to the banknote supply storing section 13 that contacts one of the stored banknotes 14 in the banknote supply storing section. The feed roller 22 discharges a stored banknote 14 to the banknote transporting unit 5 at a first predetermined speed that depends on the rotation speed of the feed roller 22 driven by the one-way clutch 24 which is driven by a driving shaft 23.

The discharged banknote is pulled into the transporting unit 5 at a second speed, which is faster than the first speed. When the banknote is pulled at the second, faster speed, feed roller 22 is still in contact with the banknote and the one-way clutch 24 driving the feed roller 22 automatically allows the banknote to be continuously pulled at the faster speed while avoiding excessive strain on the banknote at this transition.

The transporting unit 5 includes a first transporting unit 36 for receiving the discharged banknote and moving the banknote through an initial portion of the transporting unit 5, a second transporting unit 38 for receiving the discharged banknote from the first transporting unit 36 and moving the banknote through an intermediate portion of the transporting unit, a diverting unit 39 for diverting a defective banknote to a rejected banknote storing section 12, a third transporting unit 41 for receiving the discharged banknote from the second transporting unit 38 and moving the banknote through a final portion of the transporting unit, and three sensors (47, 48, 49) that are used to determine if the banknote has been transported successfully through the transporting unit 5.

The path from the first transporting unit 36 through the second transporting unit 38 to the third transporting unit 41 is considered a first path, and is the normal path a discharged banknote will take if the banknote is not defective and the banknote transporting unit 5 does not jam or otherwise fail to properly transport the discharged banknote. This first path may also be called the normal banknote discharge path since the banknote will normally be discharged to the package dispensing tray 51 which is a temporary storing section prior to dispensing one or more accumulated banknotes to the dispensing slot 50.

The path from the first transporting unit 36 through the second transporting unit 38 and to the diverting unit 39 is considered a second path, and is the path a discharged banknote will take if the banknote is defective. This second path may also be called the rejected banknote storage path since the rejected banknote will be stored in the rejected banknote storing section 12.

The four sensors (47, 48, 49, 52) may be of various designs such as a transmitting photoelectric sensor, a reflecting photoelectric sensor, or mechanical sensor to detect the presence of a banknote between the emitter/receiver pair in order to determine the presence and length of the banknote given the known transport speeds of the moving elements. More sophisticated sensors may be employed to detect properties other than the length of the banknote. These properties may indicate the particular denomination, composition of the banknote, or some other distinguishing feature that the control unit 7 may use in order to determine whether the banknote is suitable for dispensing.

The four sensors (47, 48, 49, 52) each output a signal. The term signal may reflect either a particular electrical property such as a voltage or impedance level, or it may reflect a time-sequence of a particular electrical property such as a voltage or impedance waveform.

The first sensor 47 detects the presence of the banknote as it is received by the first transporting unit 36 of the banknote transporting unit 5. The second sensor 48 detects the presence of a diverted banknote prior to entering the rejected banknote storing section 12. The third sensor 49 detects the presence of the banknote as it is emitted from the transporting unit 5 at the normal discharge point. The control unit 7 receives signals from the sensors and compares the received signals to determine whether the banknote was discharged, transported, and dispensed properly.

The diverting unit 39 is used to route a selected banknote to a rejected banknote storing section 12 by interposing a deflecting element into the path of the banknote after it is received by the banknote transporting unit 5. A banknote may be rejected if it is detected to be defective or inappropriate by the control unit 7 after interpreting the signal from the first sensor 47.

Most commonly, a banknote would be found to be defective if the signal from the sensor 47 indicated the banknote was the wrong size, either too long or too short. Such a banknote would not be dispensed, and would instead be stored in the rejected banknote storing section 12.

The package dispensing unit 55 receives a predetermined number of discharged banknotes from the third transporting unit 41 prior to dispensing the banknotes to the user. The package dispensing unit 55 includes the package dispensing member 6, the package dispensing tray 51, the banknote sensor 52 and the dispensing slot 50. The package dispensing member 6 is a sliding member with a pushing block 53 for contacting the accumulated banknotes and sliding them towards the dispensing slot 50.

The predetermined number of discharged banknotes may be any permissible number determined by the control unit 7. For example, the predetermined number of discharged banknotes can be four in order to accommodate change from a five dollar bill, or can be nine in order to accommodate change from a ten dollar bill. The local banknotes used, the parameters of the control unit operation, and the predetermined number of discharged banknotes may vary.

Once the predetermined number of banknotes are accumulated in the package dispensing tray 51, the package dispensing member 6 is used to dispense the accumulated discharged banknotes to the user. The package dispensing member 6 is activated by the control unit 7. As the activated dispensing member 6 slides towards the dispensing slot 50, the pushing block 53 on the package dispensing member moves the assembled banknotes past the banknote sensor 52 to the dispensing slot 50, so that a portion of the dispensed the accumulated banknotes extend beyond the dispensing slot 50. The portion of the dispensed banknotes extending beyond the dispensing slot 50 may be grasped by a user so that the dispensed banknotes may be removed from the banknote dispensing unit 1. After this, the dispensing unit 6 slides in the opposite direction to return to its original position at the end of the package dispensing tray 51 and opposite to the dispensing slot 50.

In reference to FIG. 1, the banknote dispensing unit 1 includes a box-like chassis 2. The box-like chassis 2 has a cavity that is adapted to receive a banknote safe 8 into a banknote safe attaching section 3. The banknote safe attaching section 3 has a substantially trapezoidal shape to accommodate the banknote safe 8 which includes the banknote supply storing section 13 for retaining stored banknotes 14 at an angle inclined to horizontal. The banknote safe 8 comprises a removable storage unit that is ruggedly constructed for increased durability and to resist tampering.

The stored banknotes 14 are held at an inclined angle in the banknote supply storing section 13 to accommodate larger banknotes in a shorter longitudinal length of the banknote dispensing device 1, and to facilitate the discharge of banknotes by the assistance of gravity as the banknotes are discharged in a slightly downward direction. The shorter longitudinal length allows the dispensing device 1 to occupy a more compact space while dispensing larger banknotes.

Inside of banknote safe 8 is a banknote supply storing section 13 for retaining stored banknotes 14 prior to dispensing and a rejected banknote storing section 12 for retaining banknotes that have been rejected during dispensing. The banknote supply storing section 13 is separated from the rejected banknote storing section 12 by the separating plate 9.

Pusher 15 is arranged underneath the stored banknotes 14 and is biased by a spring 16 to apply pressure to the stored banknotes 14 in order to maintain the stored banknotes 14 in a position against the feed roller 22 which extends through the opening 17.

When a stored banknote 14 is discharged from the banknote supply storing section 13 by the feed roller 22, the discharged banknote slides in a slightly downward direction and through exit 18 where the separating unit 19 ensures discharged banknotes are separated one-by-one to prevent the discharge of more than one banknote at a time.

Banknotes are discharged from the banknote supply storing section 13 at a first speed determined by the rotation speed of the feed roller 22. Once the discharged banknote passes separating unit 19, the discharged banknote passes the first sensor 47 and is received by first transporting unit 36 in the banknote transporting unit 5. The first sensor 47 outputs a signal to the control unit 7 indicating the beginning, end, and duration of time the banknote is detected by the first sensor 47 based on the transport speed of the banknote in the first transporting unit 36.

Given the known parameters of the transport speed of the discharge unit 4, the discharge speed of the first transporting unit 36, and the expected length of the banknote, the control unit 7 can determine if the banknote is defective and should be retained in the rejected banknote storing section 12 rather than dispensed from the banknote dispensing unit 1.

The first transporting unit 36 includes a second motor 43 for driving a first roller 42 and a guiding unit 37 for driving a discharged banknote through the initial portion of the banknote transporting unit 5. The U-shaped guiding unit 37 and the first roller 42 have companion pressure rollers 56, 58 and 60 arranged at their periphery to form a passageway for the discharged banknote between the first roller 42 and the pressure rollers. Similarly, the guiding unit 37 has companion pressure rollers to form a passageway for the discharged banknote. The discharged banknote is driven by the first roller 42 at a substantially higher speed than the feed roller 22.

To prevent damage to the discharged banknote, the feed roller 22 is driven by a one-way clutch attached to the driving shaft 23 so that even though the discharged banknote is driven at a first speed by the feed roller 22, the discharged banknote may be continuously pulled at a second, higher speed by the first roller 42. The one-way clutch 24 allows the banknote to be continuously pulled at the higher speed, and does not limit the length of the banknote that may be pulled at a higher speed.

Figure 2:
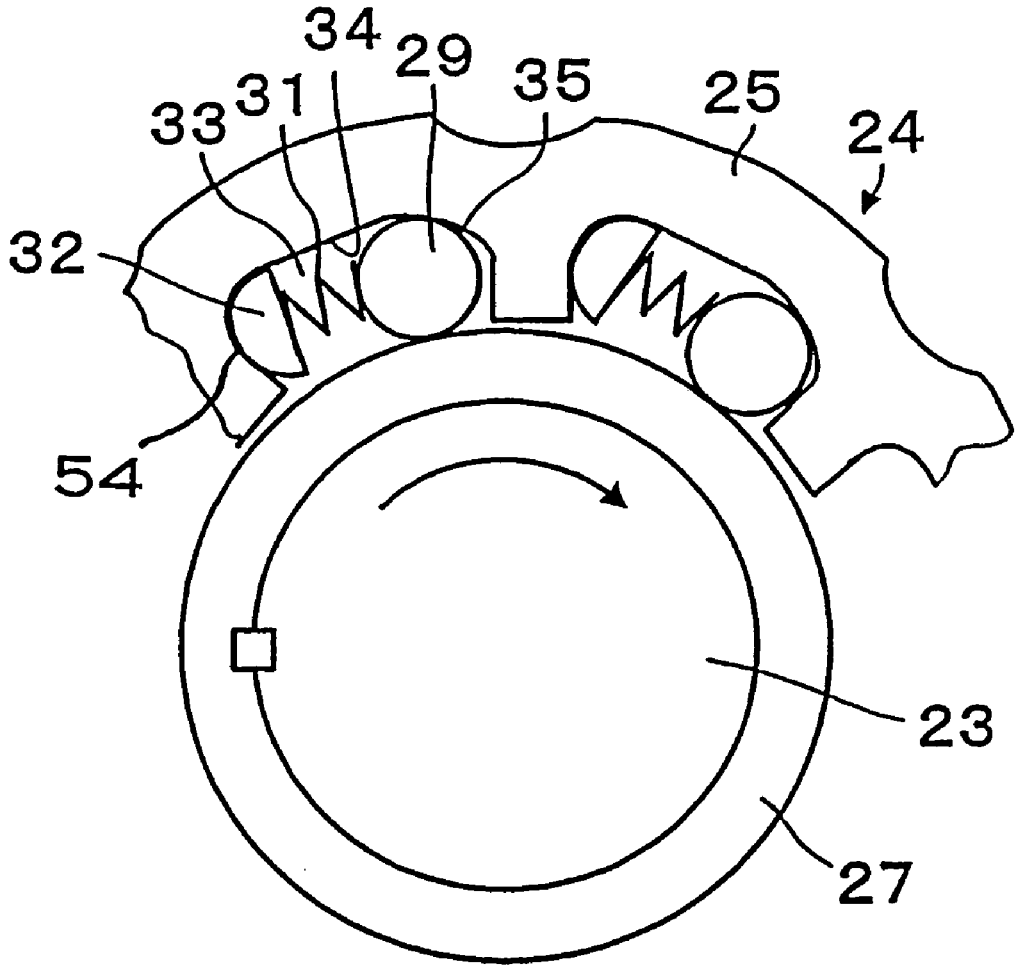
FIG. 2 shows an embodiment of the one-way clutch where the driving shaft is driving the peripheral edge of the feed roller.

In reference to FIG. 2, feed roller 22 is a friction roller which is cylindrical in shape and is fixed at the outer surface of the outer race 25 of the one-way clutch 24. Alternatively, the feed rollers and companion rollers may be cylindrical segments arranged oppositely, to reduce cost while maintaining positive contact with the banknote. In one embodiment, the feed roller 22 comprises a material with a high coefficient of friction as well as durability and high wear resistance. Ethylene Propylene Diene Monomer (EPDM) is an example of a suitable material for the feed roller 22.

The one-way clutch 24 includes an outer race 25 and an inner race 27 where the inner race 27 is fixed to a driving shaft 23. On the interior region of the outer race 25 are a number of holding grooves 33. Each holding groove 33 comprises a locking wall 35, a releasing wall 34, and a retainer wall 54.

Each holding groove 33 is U-shaped and contains a retainer 32, a spring 31, and a ball 29 that are arranged so that the retainer 32 is adjacent to the retainer wall 54, the ball 29 is adjacent to the locking wall 35, and the spring 31 is interposed between the retainer 32 and the ball 29 in order to bias the ball 29 against the locking wall 35.

As shown in FIG. 2, the locking wall 35 is a narrowing of the holding groove 33 in a dimension radial to the driving shaft 23 so that when the ball 29 is placed against the holding groove 33, the inner race 27 is driving the outer race 25 in a clockwise direction. This describes how the driving shaft 23 is driving the outer race 25 in the direction of rotation.

Figure 3:
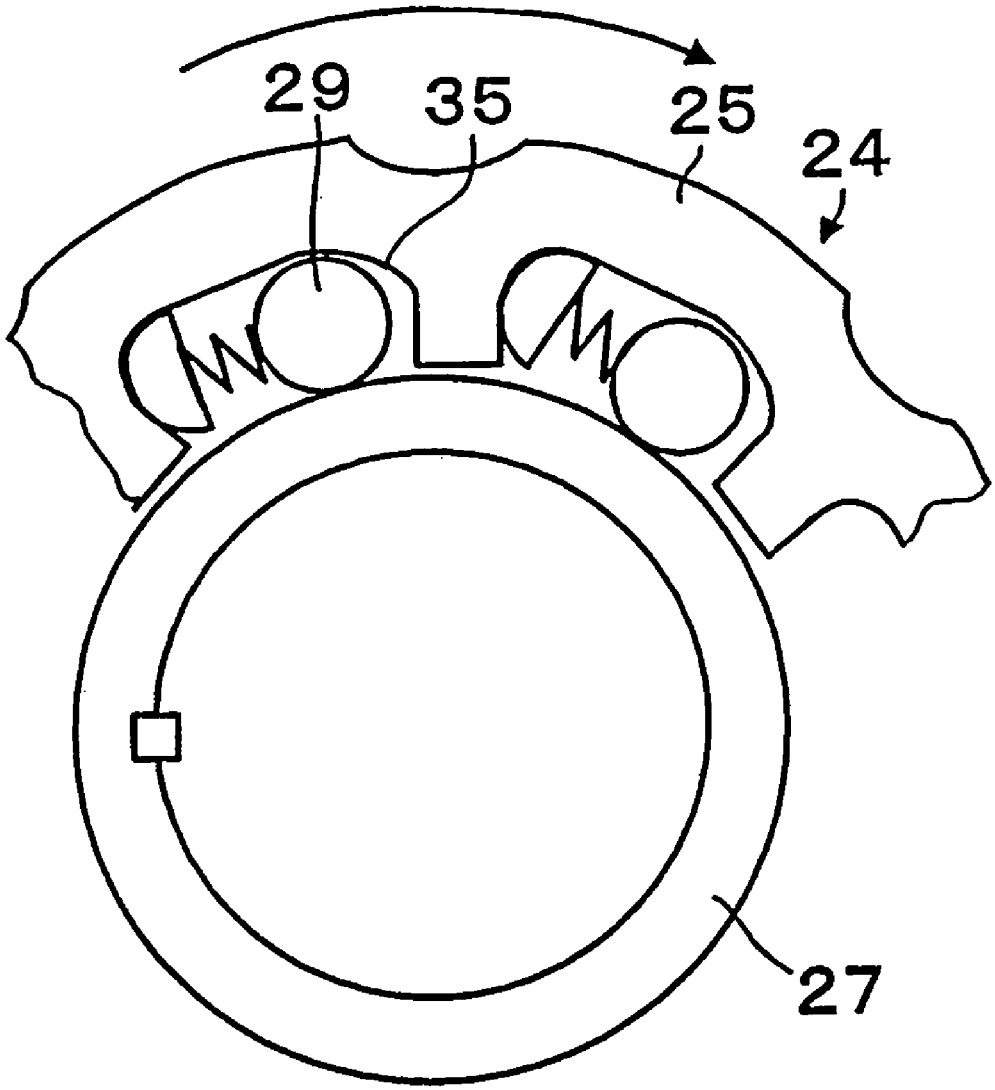
FIG. 3 shows an embodiment of the one-way clutch where the peripheral edge of the feed roller is allowed to advance faster than the rotation speed of the driving shaft.

As shown in FIG. 3, when the outer race 25 is driven faster than the driving shaft 23, such as when the first roller 42 is pulling a banknote, the ball 29 is forced in the direction of the retainer 32 compressing the spring 31 and allowing the outer race to slide over the inner race 27 to permit the outer race 25 to rotate faster in the direction of rotation than the inner race 27. This describes how the outer race 25 may be pulled faster than the rotation speed of the driving shaft 23 to prevent damage to a banknote.

Referring again to FIG. 1, the second transporting unit 38 includes a second roller 44, a diverting unit 39, a second sensor 48, and a drawing unit 21. The second transporting unit 38 receives the discharged banknote from the first transporting unit 36 and passes the discharged banknote through an intermediate portion of the banknote transporting unit 5.

If a banknote is detected as being defective, it is rejected before being dispensed from the dispensing device 1. A rejected banknote is deflected by the diverting unit 39 and stored in the rejected banknote storing section 12 which is located below the separating plate 9. The diverted banknote passes through the second transporting unit, around the second roller 44, is deflected by the diverting unit 39 and then pulled between rollers in the drawing unit 21 to enter the rejected banknote storing section 12. The rejected banknotes are thereby stored in a lower portion of the safe 8 to permit later examination and possible removal from circulation. The second sensor 48 detects the presence of the discharged banknote on the way to the rejected banknote storing section 12.

If the discharged banknote is not determined to be defective, the third transporting unit 41 receives the discharged banknote from the second transporting unit 38 and passes the discharged banknote through the final portion of the banknote transporting unit 5. The third transporting unit 41 includes a third roller 46, a third sensor 49, and companion rollers for the third roller 46.

The second roller 44 and the third roller 46 are driven by a belt 45 that is driven by a friction roller placed against the first roller 42. This provides synchronization of the rollers and ensures the rollers are driven at the same speed. The synchronization and driving method is not limited to only a belt as other means such as gears may also be used.

Figure 4:
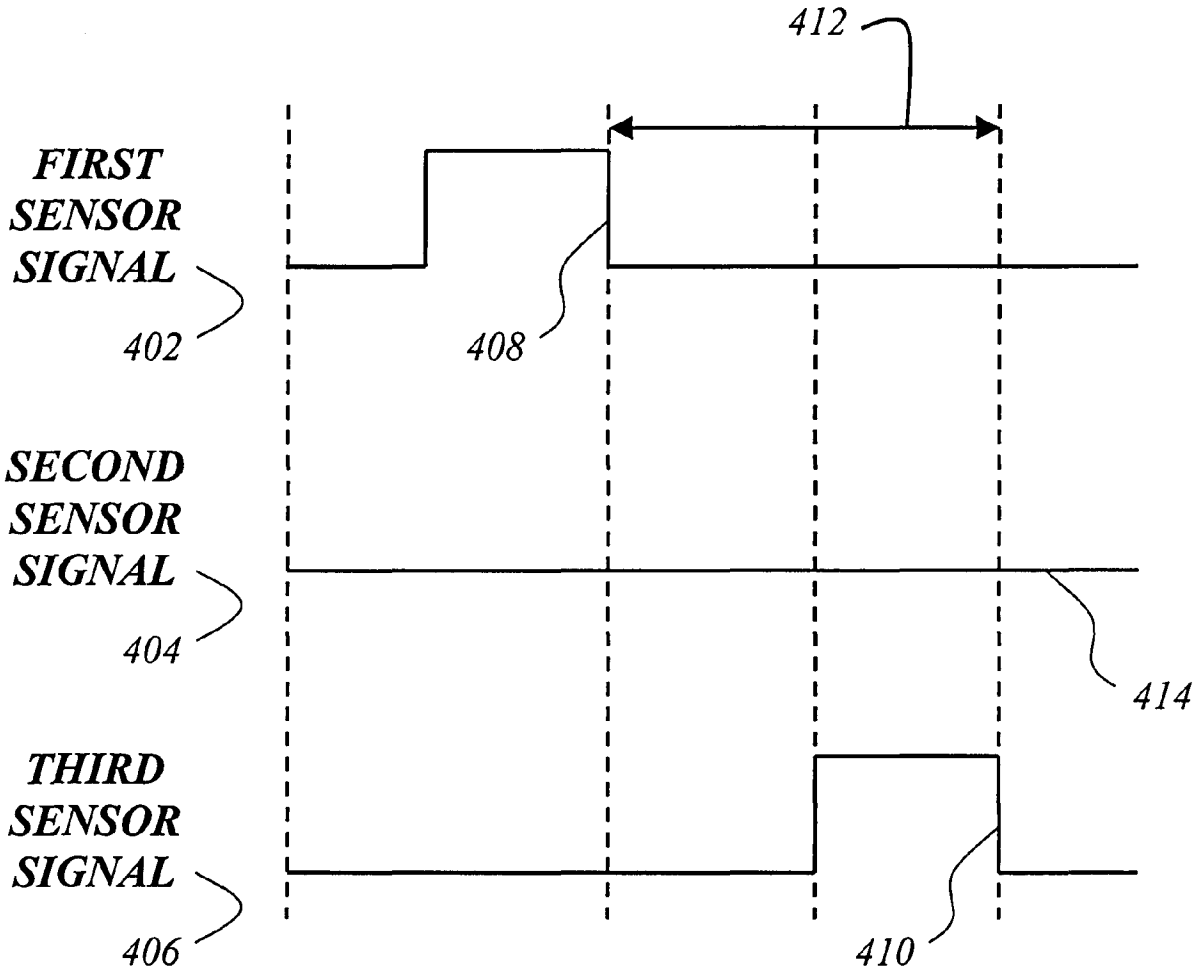
FIG. 4 shows the transfer of a banknote from the banknote supply storing device through the banknote transport device to the normal banknote discharge section.

In reference to FIG. 4, the first sensor signal 402 shows receiving a banknote into the first transporting unit 36 and discharging the banknote from the third transporting unit 41 into the package dispensing tray 51. This indicates the banknote transporting unit 5 has successfully transported the discharged banknote. The time delay 412 depends on the transporting speed through the first transporting unit 36, the second transporting unit 38, and the third transporting unit 41.

The time delay may be measured from the falling edge 408 of the first sensor signal 402 to the falling edge 410 of the third sensor signal 406. Similarly, the time delay may be measured from the difference between the rising edges (not labeled) of each of the sensor signals, but the falling edge measurement is more reliable since it is more clear that the detected banknote has cleared the particular sensor.

Figure 5:
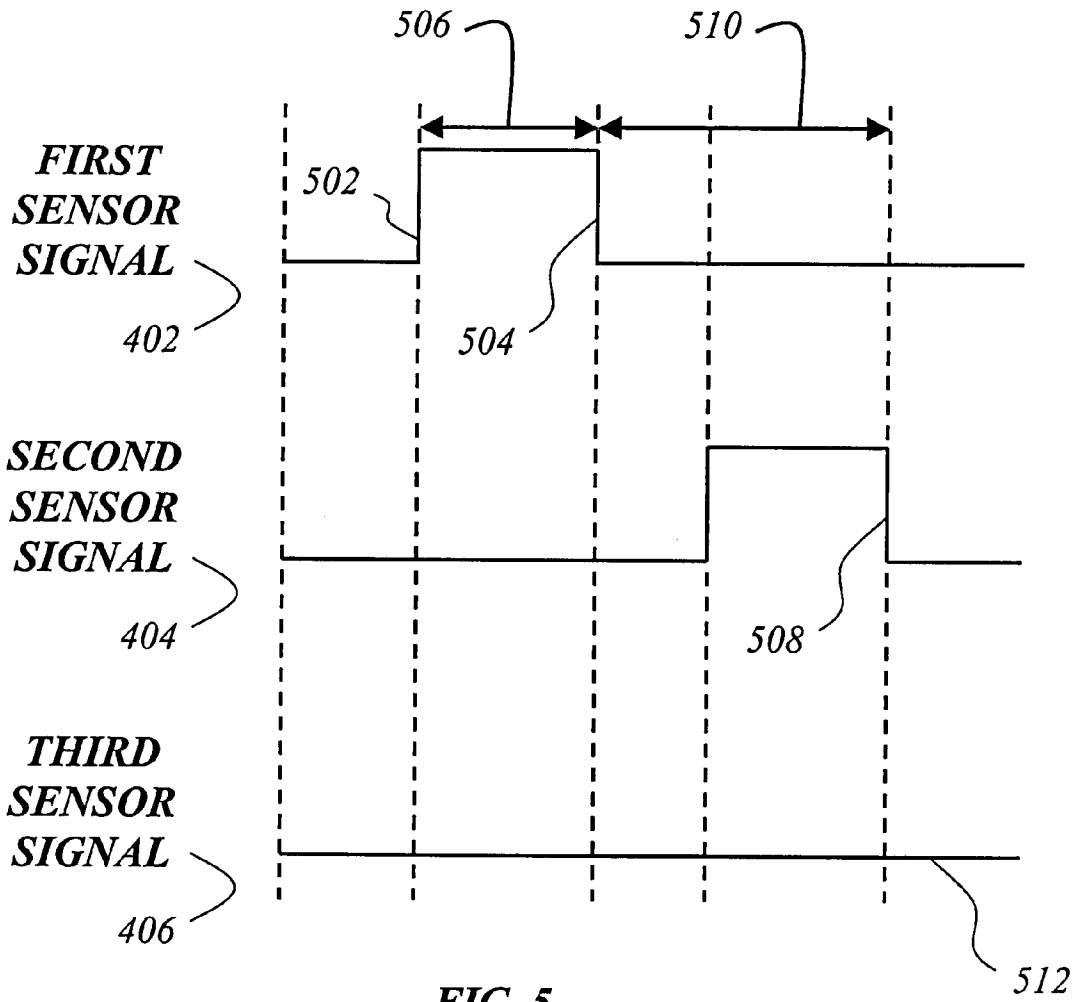
FIG. 5 shows the transfer of a banknote from the banknote supply storing device through the banknote transport device to the rejected banknote storing section.

In reference to FIG. 5, the banknote was determined to be defective and was successfully diverted to the rejected banknote storing section. The first sensor signal 402 detected the presence of a banknote as it was received by the first transporting unit 36. However, given the parameters of the known rotation speed of the feed roller 22 and the first roller 42 in the first transporting unit 36, together with the expected length of the banknote, the duration of the first sensor signal 402 may have been shorter or longer than expected.

The duration 506 of the first sensor signal detecting the discharged banknote is measured as the time difference from the rising edge 502 to the falling edge 504. Since the discharged banknote is determined to be defective, it is diverted to the rejected banknote storing section 12 by the second transporting unit 38.

Figure 6:
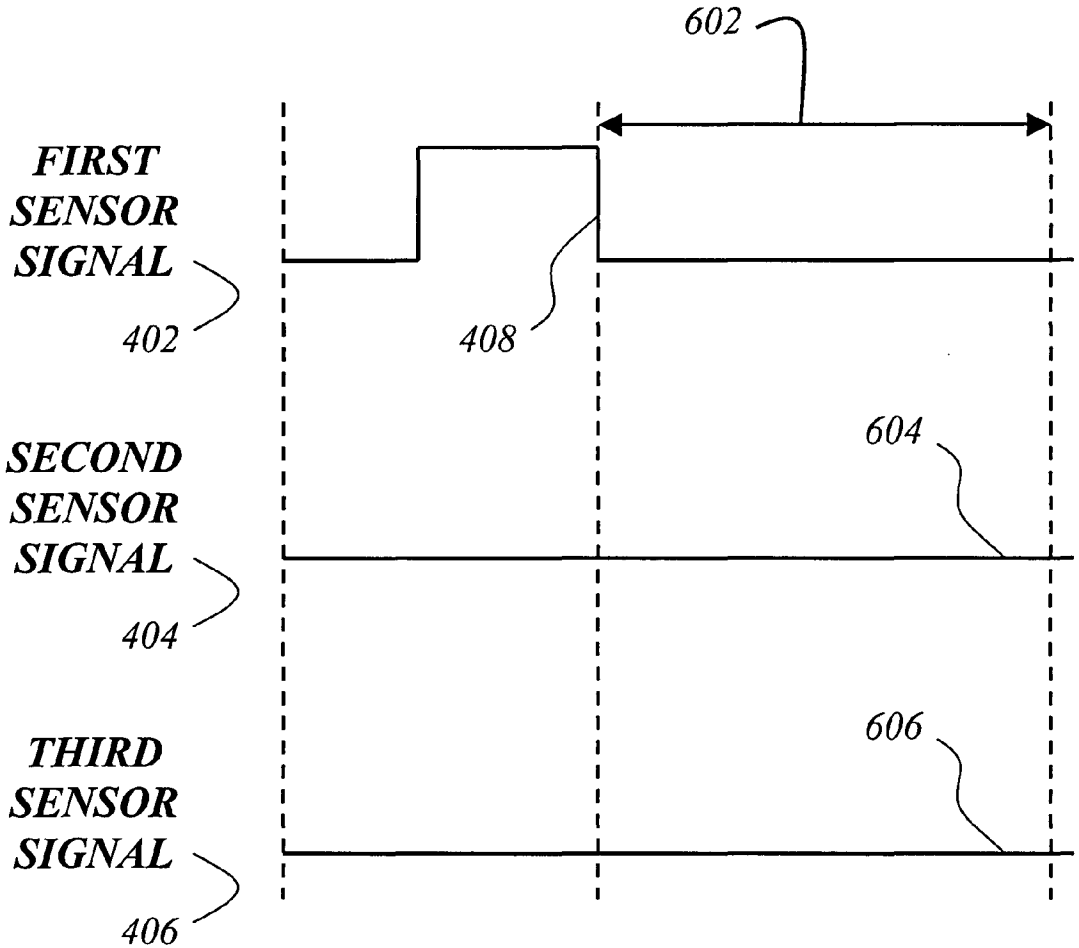
FIG. 6 shows the transfer of a banknote from the banknote supply storing device through the transport device where the discharged banknote becomes jammed prior to the second transporting unit and does not successfully pass through the banknote transport unit.

In reference to FIG. 6, a discharged banknote has been received by the first transporting unit 36, but the banknote was not successfully discharged into either the rejected banknote storing section 12 or successfully discharged into the package dispensing tray 51. This indicates an error condition like a jamming of the banknote in the banknote transporting unit 5 or the failure of one or more sensors. The control unit 7 detects this condition and stops motors 20 and 43.

The control unit 7 receives and processes signals from the sensors and determines the control of the first motor 20, the second motor 43, and the movement of the package dispensing member 6. The control unit 7 can include a microprocessor with appropriate interface circuits under the control of a microprogram, or can include discrete electronic components used to perform the controlling function.

Those skilled in the art will appreciate that various adaptations and modifications of the just-described preferred embodiment can be configured without departing from the scope and spirit of the invention. Therefore, it is to be understood that, within the scope of the amended claims, the invention may be practiced other than as specifically described herein.

What is claimed is:

1. A banknote dispensing device, comprising:

a banknote supply storing section for storing banknotes;

a food roller having a peripheral edge disposed adjacent to the banknote supply storing section at a fixed position, the feed roller being driven by a one-way clutch attached to a driving shaft, the feed roller discharging banknote one at a time from the banknote supply storing section at a first predetermined speed;

a transporting unit for receiving a banknote from the banknote supply storing section and transporting the banknote at a second predetermined speed from the banknote supply storing section, the second predetermined being faster than the first predetermined speed, the transporting unit includes a first roller and pressure roller which have contact with their periphery to form a passageway for the banknote which has contact with the feed roller and pressure roller at the same time, wherein the feed roller discharges to banknote at the first predetermined speed while allowing the banknote to be continuously pulled by the transporting unit at the second predetermined speed;

a first sensor for detecting the presence of the banknote received by the transporting unit, the first sensor outputting a first signal to indicate the presence of the banknote adjacent to the first sensor;

another sensor for detecting the presence of the banknote as the banknote is emitted by the transporting unit, the another sensor outputting another signal to indicate the presence of the banknote adjacent to the another sensor;

a diverting unit for diverting the banknote from a first path to a second path, the first path being a normal banknote discharge path;

a rejected banknote storing section, the second path being a rejected banknote storage path; and a reject sensor for detecting the presence of the banknote adjacent the reject sensor, the reject sensor outputting a reject signal to indicate successful passage of the banknote through the transporting unit to the rejected banknote storing section; and a control unit for receiving and processing the first signal and the another signal, the control unit comparing the timing of the first signal with the another signal to determine whether the banknote has properly passed through the transporting unit, wherein the banknote supply storing section and the rejected banknote storing section comprise a removable safe unit.

2. A banknote dispensing device, comprising:

a removable safe unit, the removable safe unit including a banknote supply storing section for retaining a supply of banknotes;

a banknote discharge unit, the banknote discharge unit including a feed roller having a peripheral edge disposed at a fixed position adjacent to the banknote supply storing section, the peripheral edge of the feed roller for contacting a banknote in the banknote supply storing section, the feed roller being driven by a one-way clutch attached to a driving shaft driven by a first motor, the feed roller discharging banknotes one at a time from the banknote supply storing section at a first predetermined speed;

a transporting unit for receiving the banknote from the banknote supply storing section and transporting the banknote at a second predetermined speed from the banknote supply storing section, the second predetermined speed being faster than the first predetermined speed, the banknote discharge unit feed roller discharging the banknote at the first predetermined speed while allowing the discharged banknote to be continuously pulled by the transporting unit at the second predetermined speed, the transporting unit being driven by a second motor;

an accumulating unit for receiving one or mere banknotes from the transporting unit, the accumulating unit having a package dispensing member for dispensing the accumulated banknotes to a user;

a control unit for controlling the operation of the first motor, the second motor, and the package dispensing member to dispense the accumulated discharged banknotes to the user;

a first sensor for detecting the presence of the banknote received by the transporting unit from the banknote discharge unit, the first sensor outputting a first signal to the control unit indicating a predetermined property of the banknote adjacent to the first sensor;

another sensor for detecting a predetermined property of the banknote as the banknote is passed to the accumulating unit of the dispensing device, the another sensor outputting another signal to the control unit indicating successful passage of the banknote through the transporting unit into the accomulating unit, wherein the control unit receives and processes the first signal and the another signal, the control unit compares the timing of the first signal with the another signal to determine whether each banknote has properly passed through the transporting unit to the accumulating unit;

a rejected banknote storing section for retaining rejected banknotes, the rejected banknote storing section being included in the removable safe unit; and a diverting unit for selectively diverting the banknote to the rejected banknote storing section, wherein the control unit determines from the first signal whether the banknote is rejected, the control unit selectively activating the diverting unit for a rejected banknote.

3. The banknote dispensing device of claim 2, further comprising:

a reject sensor for detecting the presence of the banknote diverted by the diverting unit, the reject sensor outputting a reject signal to the control unit indicating a predetermined property of the banknote adjacent to the reject sensor, wherein the control unit receives and processes the reject signal, the control unit compares the timing of the first signal with the reject signal to determine whether each rejected banknote has properly passed through the transporting unit to the rejected banknote storing section.

* * * * *